US010102756B2

(12) United States Patent
Burke et al.

(10) Patent No.: US 10,102,756 B2
(45) Date of Patent: Oct. 16, 2018

(54) METHOD AND APPARATUS FOR PROVIDING IN-FLIGHT PILOT INTERFACE FOR TRAJECTORY OPTIMIZATION

(71) Applicant: The United States of America as represented by the Administrator of the National Aeronautics and Space Administration, Washington, DC (US)

(72) Inventors: Kelly Ann Burke, Virginia Beach, VA (US); David J. Wing, Hampton, VA (US); Joseph G. Ponthieux, Yorktown, VA (US); Sharon Woods, Ayer, MA (US); Stephen DePascale, Tyngsboro, MA (US)

(73) Assignee: The United States of Americ as represented by the Administrator of NASA, Washington, DC (US)

( * ) Notice: Subject to any disclaimer, the term of this patent is extended or adjusted under 35 U.S.C. 154(b) by 0 days.

(21) Appl. No.: 14/871,362

(22) Filed: Sep. 30, 2015

(65) Prior Publication Data

US 2016/0180715 A1 Jun. 23, 2016

Related U.S. Application Data

(60) Provisional application No. 62/058,390, filed on Oct. 1, 2014, provisional application No. 62/058,423, filed on Oct. 1, 2014.

(51) Int. Cl.
*G08G 5/00* (2006.01)

(52) U.S. Cl.
CPC ..... *G08G 5/0013* (2013.01); *G08G 5/006* (2013.01); *G08G 5/0008* (2013.01); (Continued)

(58) Field of Classification Search
CPC .. G08G 5/0008; G08G 5/0013; G08G 5/0021; G08G 5/0039; G08G 5/0056; G08G 5/006; G08G 5/0078; G08G 5/0091
See application file for complete search history.

(56) References Cited

U.S. PATENT DOCUMENTS 7,392,486 B1 * 6/2008 Gyde ..... B64D 43/00 701/14
8,185,299 B2 * 5/2012 Fujiwara ..... G01C 21/3492 340/905

(Continued)

*Primary Examiner* — Aaron L Troost
(74) *Attorney, Agent, or Firm* — Jennifer L. Riley; Robin W. Edwards; Mark P. Dvorscak

(57) ABSTRACT

Systems and methods of an in-cockpit flight trajectory modification system for an aircraft are provided. A receiver is capable of receiving flight-related hazard information. A traffic aware planner (TAP) module is operably connected to the receiver to receive the flight-related hazard information. A user interface device is operably connected to the TAP module on board the aircraft to provide trajectory information associated with the aircraft and to receive user input corresponding to a request for a revised trajectory. A TAP application is capable of calculating one or more revised trajectories for the aircraft based at least on active trajectory information of the aircraft and the flight-related hazard information. The user interface device may be configured to display information related to the one or more revised trajectories, including a graphic display of the active trajectory and at least one revised trajectory in a visualization panel of the user interface device.

20 Claims, 7 Drawing Sheets

(52) U.S. Cl.
CPC ..... *G08G 5/0021* (2013.01); *G08G 5/0039* (2013.01); *G08G 5/0056* (2013.01); *G08G 5/0078* (2013.01); *G08G 5/0091* (2013.01)

(56) References Cited

U.S. PATENT DOCUMENTS

| | | | | |
|---|---|---|---|---|
| 8,843,303 | B1 * | 9/2014 | Young | G08G 5/0039 701/122 |
| 2009/0319100 | A1 * | 12/2009 | Kale | G08G 5/0013 701/4 |
| 2013/0080043 | A1 * | 3/2013 | Ballin | G08G 5/0034 701/120 |
| 2016/0057032 | A1 * | 2/2016 | Tieftrunk | G01C 21/00 701/533 |
| 2016/0078770 | A1 * | 3/2016 | Coulmeau | G08G 5/0039 701/3 |

* cited by examiner

METHOD AND APPARATUS FOR PROVIDING IN-FLIGHT PILOT INTERFACE FOR TRAJECTORY OPTIMIZATION

CROSS-REFERENCE TO RELATED PATENT APPLICATION(S)

This patent application claims the benefit of and priority to U.S. Provisional Patent Application No. 62/058,390, filed on Oct. 1, 2014 and U.S. Provisional Patent Application No. 62/058,423, filed on Oct. 1, 2014, the entire contents of which are hereby incorporated by reference in their entireties.

STATEMENT REGARDING FEDERALLY SPONSORED RESEARCH OR DEVELOPMENT

The invention described herein was made in part by employees of the United States Government and may be manufactured and used by and for the Government of the United States for governmental purposes without the payment of any royalties thereon or therefore.

BACKGROUND OF THE INVENTION

Requests for aircraft trajectory changes are regularly made by pilots to air traffic controllers during flight. Such requests are more likely to be approved if the requested trajectory does not conflict with trajectories of other traffic aircraft and does not put the aircraft in a path toward another hazard, such as high wind turbulence or inclement weather.

In addition, approvable trajectory change requests benefit the aircraft operator by increasing the portion of the flight flown on or near a desired trajectory, thereby accomplishing various operator objectives for the flight such as maximizing fuel efficiency, minimizing flight time, and/or reducing the impact of turbulence on ride quality. Approvable trajectory changes also benefit the air traffic controllers by reducing their workload through reduction of non-approvable trajectory change requests.

There remains a need, however, for systems and methods for generating flight-optimizing trajectories by pilots with an user-friendly device interface that allows for user selection of various inputs to obtain trajectory changes that are more likely to be approved by air traffic controllers and/or that offer greater operator objectives.

BRIEF SUMMARY OF THE INVENTION

The following presents a general summary of aspects of this invention in order to provide a basic understanding of at least some aspects of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this disclosure generally relate to systems and methods for generating flight optimizing trajectories for aircraft, and in particular, relate systems and methods with improved user interaction features and improved likelihood of providing an approvable trajectory change request.

Aspects of this disclosure relate to an in-cockpit flight trajectory modification system for an aircraft that includes a receiver at least capable of receiving flight-related hazard information, a traffic aware planner (TAP) module operably connected to the receiver to receive the flight-related hazard information, a user interface device operably connected to the TAP module on board the aircraft to provide trajectory information associated with the aircraft and to receive user input corresponding to a request for a revised trajectory, and a TAP application capable of calculating one or more revised trajectories for the aircraft based at least on active trajectory information of the aircraft and the flight-related hazard information. Systems and methods for helping the pilot to identify opportunities for requesting an approvable trajectory change that achieves the aircraft operator's flight optimizing objectives have been identified in U.S. Pat. No. 8,977,482, which is incorporated herein by reference in its entirety.

The user interface device may be configured to display information related to the one or more revised trajectories, including a graphic display of the active trajectory and at least one revised trajectory in a visualization panel of the user interface device.

In certain embodiments, the user interface device may include a waypoint selection portion. Responsive to receiving one or more waypoint selections in the waypoint selection portion, the TAP application may calculate the one or more revised trajectories based at least on the one or more waypoint selections. In some implementations, the waypoint selection panel may be configured to receive at least one of an active-trajectory rejoin waypoint and a revised trajectory waypoint. Responsive to receiving an active-trajectory rejoin waypoint selection in the waypoint selection portion, the TAP application may calculate the one or more revised trajectories rejoining the active trajectory at the active-trajectory rejoin waypoint. Responsive to receiving a revised trajectory waypoint selection in the waypoint selection portion, the TAP application may calculate the one or more revised trajectories passing through the revised trajectory waypoint.

In some embodiments, the user interface device may be further configured to receive a user request input to submit a selected revised trajectory to an Air Traffic Control system for approval, and to display a request outcome indicator corresponding to a determination of the selected revised trajectory request to Air Traffic Control. The user interface device may include a route constraint selection portion for receiving one or more constraints used in calculating the one or more revised trajectories, a graphical display selection menu for receiving user requests to display one or more hazard levels in the visualization panel, an optimization objective display for receiving one or more user selection parameter for determining an optimal revised trajectory, and/or a data feed status display. The user interface device includes a display of the most optimal revised trajectory in a color different than remaining revised trajectories.

Further aspects relate to methods for generating/displaying an in-flight optimizing trajectory for an aircraft including inputting an optimization criteria for the aircraft into a traffic aware planner (TAP) application housed in a TAP module, receiving flight data for the aircraft with at least one internal input device operably connected to the TAP module, receiving hazard information to determine presence of one or more hazards, receiving a selection of one or more user-inputted waypoints, receiving one or more of the following data with at least one external input device operably connected to the TAP module: at least one four dimensional (4D) trajectory estimate for the aircraft; at least one 4D space to avoid by the hazard information, calculating and generating at least one flight optimizing trajectory for the aircraft with the TAP application based on the optimization criteria and the received data, the trajectory including at least one user-inputted waypoint, and displaying the information of a user interface device in a cockpit of the aircraft. The user interface device may be configured to display information related to the one or more revised trajectories, including a graphic display of the active trajectory and at least one revised trajectory in a visualization panel of the user interface device.

In certain embodiments, one or more waypoints may be received for determining one or more revised flight trajectories. A request to change the active flight trajectory may be sent to air traffic control, the request included the selected optimal revised flight trajectory. One or more route constraints may be received for determining one or more revised flight trajectories. The one or more revised flight trajectories displayed in the visualization panel may include displaying the received hazard information on the map. The one or more revised flight trajectories in the visualization panel may include displaying a most optimal route in a different color from a display of remaining flight trajectories. Calculating the one or more revised flight trajectories may include determining an optimal flight trajectory for a lateral modification, a vertical modification, and for a combination modification.

Still further aspects relate to a method for generating/displaying an in-flight optimizing trajectory for an aircraft, including displaying a first display page comprising a startup checklist, responsive to a user verification of the startup checklist, activating a second display page comprising of a plurality of route constraint selections, responsive to a user constraint selection input, activating a third display page comprising revised trajectory information the third display page including a graphic display of the active trajectory and at least one revised trajectory in a visualization panel of the user interface device, storing a pending modification for the flight management task for at least one of a review step or an execution step, and displaying the information of a user interface device in a cockpit of the aircraft. The user interface device is configured to display information related to the one or more revised trajectories, including a graphic display of the active trajectory and at least one revised trajectory in a visualization panel of the user interface device.

These and other features, advantages, and objects of the present invention will be further understood and appreciated by those skilled in the art by reference to the following specification, claims, and appended drawings.

FIG. SA is a schematic view of a third user interface device in accordance with an embodiment.

Figure 5A:
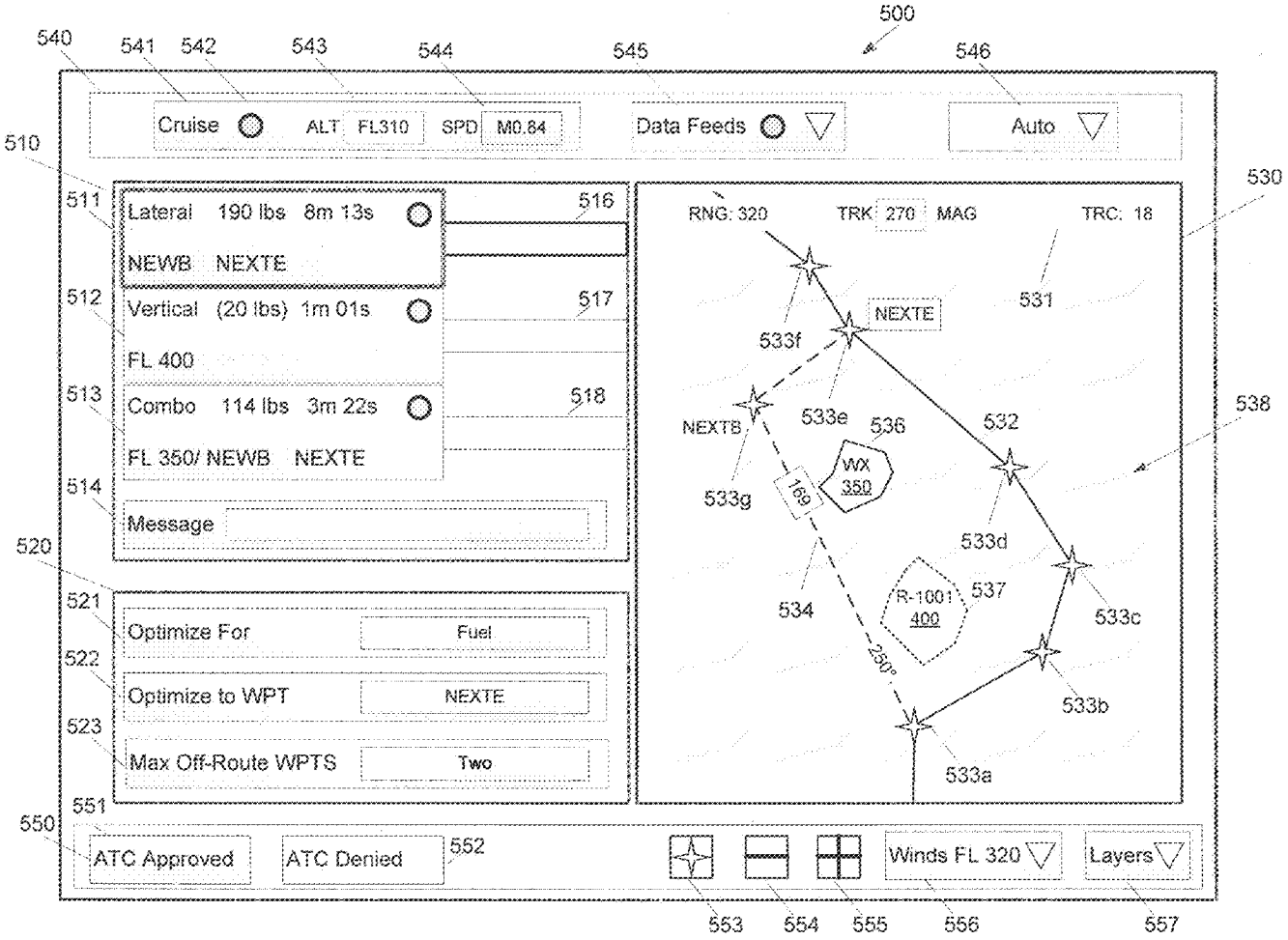
Figure 5B:
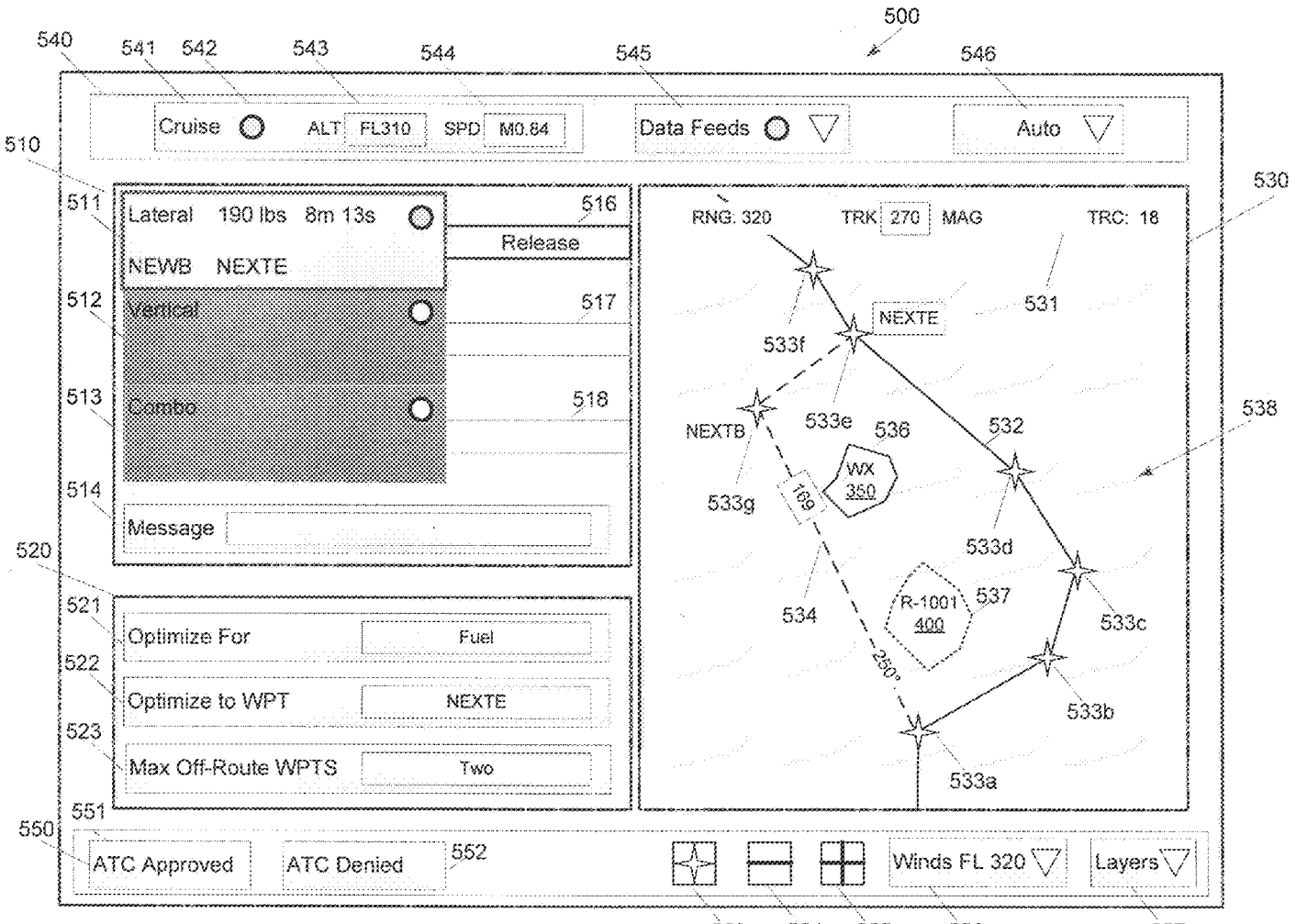

FIG. 5B is another schematic view of the third user interface device of FIG. 5A.

Figure 6:
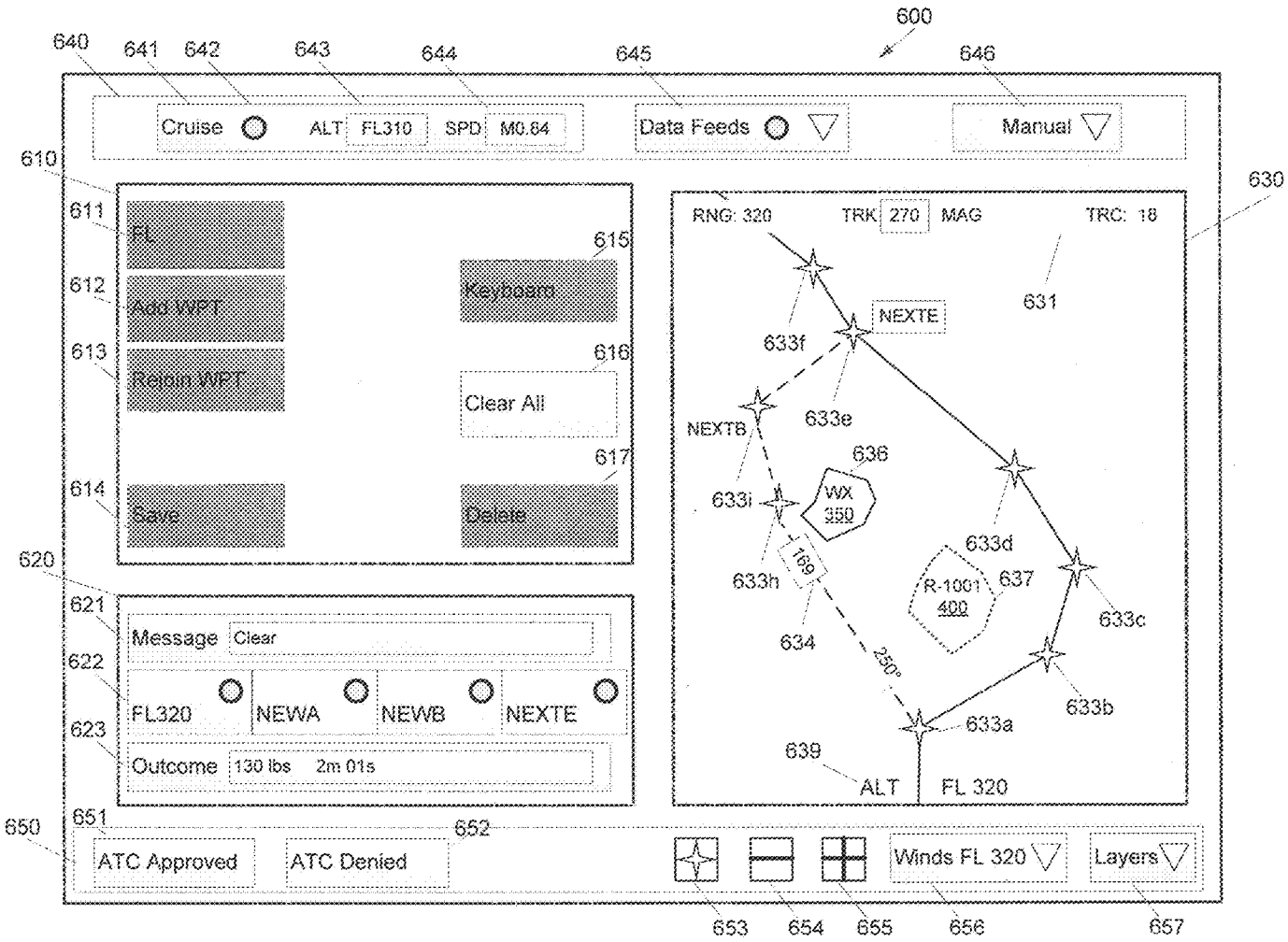

FIG. 6 is a schematic view of a fourth user interface device in accordance with an embodiment.

DETAILED DESCRIPTION OF THE INVENTION

Figure 1:
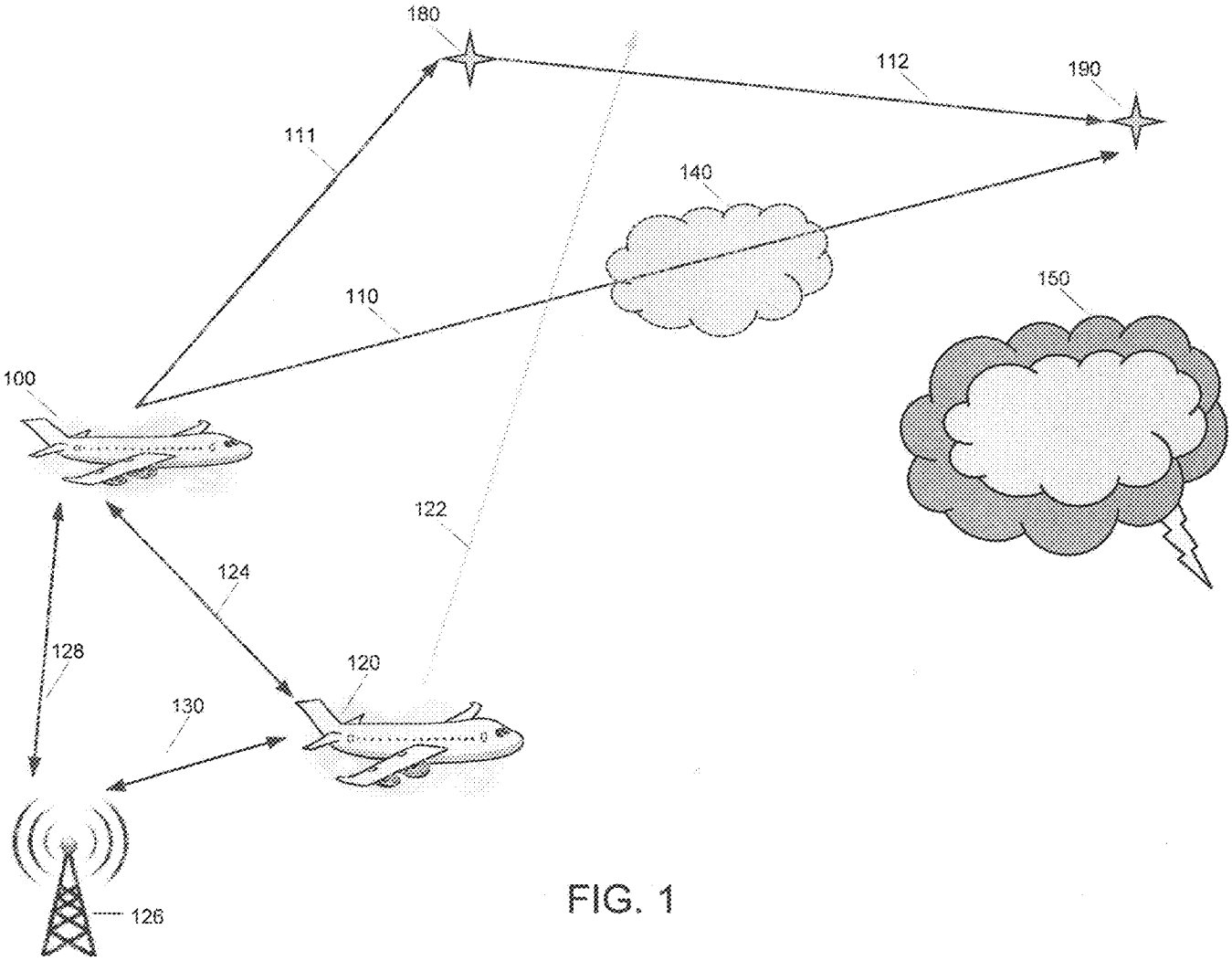
FIG. 1 is a graphical representation of an aircraft equipped with a system in accordance with an embodiment.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present disclosure relates to methods and systems for generating optimized flight trajectories while an aircraft in flight. The methods and systems of the present disclosure may be applied in the cockpit of an aircraft and may include a user interface device for receiving user selection and displaying active and revised/optimized flight trajectories.

As should be apparent to those skilled in the art, aircraft operating under Instrument Flight Rules ("IFR") must fly trajectories approved by Air Traffic Control ("ATC"). The approved trajectory flown by an IFR aircraft is generally the trajectory originally specified in a flight plan, as modified by any subsequent ATC clearance received for changes in the flight plan prior to takeoff, and/or as changed or negotiated and approved by the ATC after takeoff, during the flight. In other words, an IFR aircraft trajectory may be altered before and during flight. The trajectory approved for a particular aircraft often does not coincide with the most efficient or the most preferred trajectory for that aircraft. Flight planning and flight plan selection and filing often result in less desirable trajectories being established prior to departure. Less desirable trajectories result from combinations of variables including non-optimal routes, regulatory altitude and speed restrictions (i.e., those of a general nature, including those imposed by aviation regulations), altitude restrictions issued by ATC before or during the flight, speed restrictions issued by ATC before or during the flight, changing conditions during the flight, and/or changing aircraft operator priorities during the flight.

Some causes of in-flight priority changes include unanticipated weather patterns, convection, or turbulence development. Other causes include the need to make up time as a result of an earlier reroute to avoid traffic or weather, the need to delay arrival at the destination due to traffic congestion or similar delays, and/or the need to increase altitude as fuel is burned to improve operational efficiency. As a result of one or more of these variables, pilots occasionally have a need or desire to change their trajectory while in flight. The desired change may be a revised lateral route, a climb or descent to a different altitude, a change in airspeed, or a combination of these parameters. The desired change may be of a temporary nature, e.g., a heading change to avoid weather, or a long-term nature, e.g., a diversion to an alternate airport or destination.

Because ATC has responsibility to separate IFR aircraft, ATC maintains authority over the trajectories of all IFR aircraft in controlled airspace. IFR pilots are not permitted to make changes to an approved trajectory without first receiving permission for any such change from ATC.

Operationally, the procedure for requesting a trajectory change is well established and commonly used in practice. The pilot prepares the request and, at the appropriate time, communicates the request to the air traffic controller. The controller assesses the request, taking into account nearby traffic and other factors. If the trajectory change does not present a conflict with traffic or other factors, the air traffic controller issues an approval. In other instances, the air traffic controller may issue an amendment to a trajectory, a deferral of the request, or a denial of the request. The pilot then proceeds as instructed.

As matters currently stand, flight crews often lack up-to-date information about neighboring aircraft. Without this information, a pilot is unable to consider how a particular trajectory change request will be received by an air traffic controller. Often, trajectory change requests are denied, because the air traffic controller determines that there is a conflict between the trajectory associated with the trajectory change request and the trajectory of another aircraft. In other words, the requested trajectory change may place two aircraft into close proximity, thereby violating protocols for the appropriate distances between aircraft in a given airspace. Disapproved trajectory change requests may be an operational detriment to everyone involved. Disapproved trajectory change requests increase the workloads both for the pilot and the air traffic controller, contribute to radio frequency congestion, and/or prevent pilots from assuming more desirable trajectories for their aircraft.

U.S. Pat. No. 8,977,482 describes modes to provide additional information relevant to a determination of an approvable trajectory request and which may increase the probability of having a trajectory change approved by ATC. The additional information may include information about the proximity and trajectories of neighboring aircraft, for example, among other types of information that may be available in connection with a particular flight trajectory.

Aircraft communication and surveillance modules include, but are not limited to, devices such as an Automatic Dependent Surveillance Broadcast ("ADS-B"). ADS-B receivers provide aircraft with access to specific, helpful information that may be used to help formulate trajectory change requests that avoid other aircraft and therefore are more likely approvable by ATC. In particular, ADS-B receivers receive timely and accurate traffic surveillance information with respect to other aircraft in the immediate vicinity. ADS-B receivers acquire this surveillance data from one of two potential sources, among others (including, for example, satellites and the Internet): (1) nearby aircraft equipped with ADS-B transmitters and (2) ground-based systems such as a Traffic Information Service Broadcast (or TIS-B). The combination of information from these two sources provides a portrait of the traffic situation proximate to an aircraft. The portrait of the traffic situation proximate to an aircraft depends upon the completeness of the available information. It is contemplated that the present invention will operate with a partial portrait of the traffic situation proximate to the aircraft. It is contemplated in the future that all aircraft may be provided with suitable functionality to generate a nearly complete (or even a complete) portrait of the traffic situation proximate to the aircraft.

Additionally, onboard automation, specifically processing software, capable of performing accurate trajectory probing, aircraft performance, and/or cost-based optimization computations to aid in the identification and formulation of optimal conflict-free trajectory requests. Processing software is capable of performing trajectory optimization computations to aid in the identification and formulation of optimal conflict-free trajectory requests. The software automation computes new trajectories based on optimization criteria provided by the pilot. The processing software also uses information from uplinked weather services and onboard weather radar to identify potential weather hazards to be avoided.

When combined together, the aircraft surveillance and communication module and the processing software generate information that may be of great assistance to a pilot and the aircraft's flight crew. As a general rule, the pilot is considered to be a part of the flight crew. Therefore, reference herein to the "crew" includes the pilot. Where reference is made to the pilot only, it should be understood that the term "pilot" is not intended to be limiting of the present invention but may also refer to any member of the flight crew.

TASAR is the acronym used in connection with the present invention, otherwise known as "Traffic Aware Strategic Aircrew Requests." The TASAR installation may include components both on the aircraft and situated at a non-aircraft location, such as a ground-based station. Alternatively, the TASAR installation may be positioned at a non-aircraft location, such as a ground-based station. In such an embodiment, the aircraft may interface with the ground-based installation. In a variation of these embodiments, it is contemplated that the TASAR installation may be shared with a satellite or other airborne (or space-based) components without departing from the scope of the present disclosure.

In other words, the TASAR installation may benefit from a distributed architecture, where components at disparate locations cooperate together.

In connection with the present disclosure, TASAR also may be referred to by those skilled in the art as "Traffic Aware Strategic User Requests" ("TASUR"). Both monikers are intended to refer to the present invention and, for purposes of the instant discussion, are considered equivalents or variations of one another, as should be apparent to those skilled in the art.

One embodiment of a TASAR system is illustrated in FIG. 1. In this illustration, two aircraft 100, 120 are shown in graphic format in positional relation to one another. Aircraft 100 is equipped with a TASAR module and aircraft 120 may or may not be equipped with a TASAR module. The aircraft 100, 120 are capable of transmitting and receiving trajectory information with one another via one or more wireless aircraft-to-aircraft communication channels 124. The aircraft-to-aircraft communication channel 124 may be a dedicated channel or may be a channel shared with other communications, as should be apparent to those skilled in the art.

As a point of clarification, it is noted that the aircraft 100, 120 are not contemplated to coordinate operation with respect to one another. Each of the aircraft 100, 120 may operate independently from the other. While one aircraft 100 may receive data about the other aircraft 120 via the communication channel 124, the other aircraft 120 need not receive information about the first aircraft 100 in order for aircraft 100 to practice TASAR. Further, it is noted that the TASAR system of the present disclosure is contemplated to operate with multiple aircraft 100, 120 simultaneously and is not intended to be limited solely to two aircraft 100, 120.

In the illustration provided in FIG. 1, a ground tower 126 is shown. In one embodiment, the ground tower 126 may be a TIS-B transmitter that provides traffic surveillance information regarding several aircraft, including the aircraft 100, 120. The ground tower 126 may communicate with the aircraft 100, 120 via wireless, ground-to-air communication channels 128, 130. Communications along the wireless communication channels 124, 128, 130 may occur via suitable, two-way radio communications. The mode of the communications may be analog, digital, or any suitable variant. While radio waves are contemplated, any other electromagnetic radiation modes may be employed without departing from the scope of the present disclosure. For example, light with a wavelength greater (or less than) that of radio waves may be employed without departing from the scope of the present disclosure.

In the illustration provided in FIG. 1, a ground tower 126 is shown. In one embodiment, the ground tower 126 may be a TIS-B transmitter that provides traffic surveillance information regarding several aircraft, including the aircraft 100, 120. The ground tower 126 may communicate with the aircraft 100, 120 via wireless, ground-to-air communication channels 128, 130. Communications along the wireless communication channels 124, 128, 130 may occur via suitable, two-way radio communications. The mode of the communications may be analog, digital, or any suitable variant. While radio waves are contemplated, any other electromagnetic radiation modes may be employed without departing from the scope of the present disclosure. For example, light with a wavelength greater (or less than) that of radio waves may be employed without departing from the scope of the present disclosure. As discussed herein.

Accordingly, the TAP system of aircraft 100 may generate a new route 110 differing from an active route 111, 112 that rejoins active route 111, 112 at rejoin waypoint 190, based on various hazards including as area hazards, such as convective weather 140, 150, special use airspace, terrain, and other Air Traffic Control restrictions and traffic hazards, such as aircraft 120. The new route may be determined based on a lateral, vertical or combination route modification. Lateral modifications maintain a cruise altitude but modify a flight trajectory according before reconnecting to the active flight trajectory at a rejoin waypoint. Vertical modifications modify a cruise altitude and include either a climb or a descent. Combination modifications modify the flight trajectory as well as cruise altitude.

Figure 2:
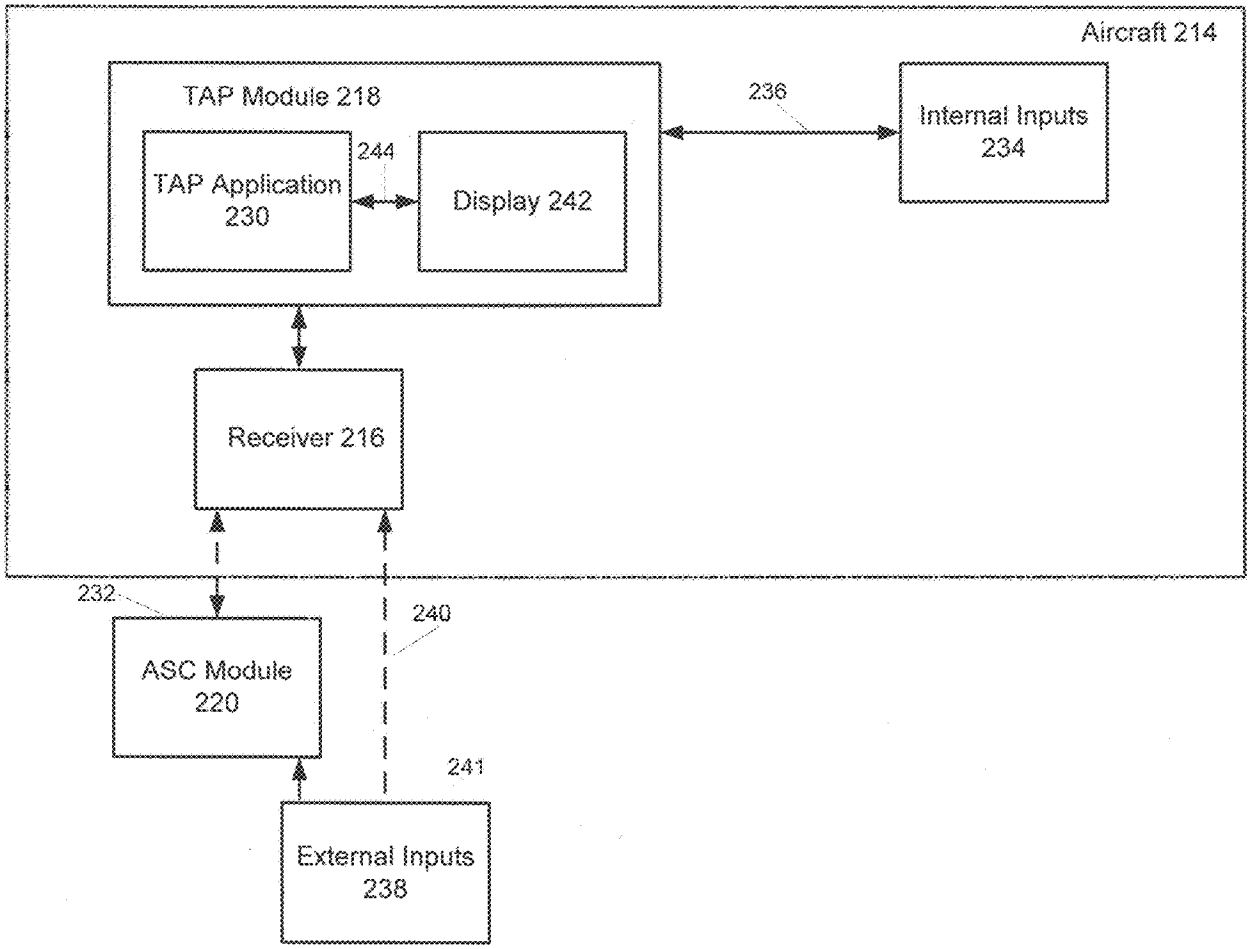
FIG. 2 is a schematic diagram of an aircraft systems architecture centered on a flight-optimizing trajectory system in accordance with an embodiment.

As shown in the illustrated embodiment of FIG. 2, the TASAR module 212 combines a receiver 216 that connects to and is in communication with a trajectory software module 218, also referred to herein as a TAP ("Traffic Aware Planner") module 218. As discussed herein, the receiver 216 may be a part of an aircraft surveillance and communication module 220 (referred to herein as an "ASC module" 220). An aircraft surveillance and communication module 220 combines a surveillance module together with a communications module. The communications module may also include the receiver 216 and/or a transmitter (not shown). The surveillance module provides surveillance functionality with respect to surveying other aircraft proximate to the aircraft.

An ADS-B transmitter/receiver represents one contemplated embodiment of the aircraft surveillance and communication module 220. An ADS-B transmitter/receiver, therefore, should not be considered to be limiting of the scope of the present disclosure. For simplicity of the discussion that follows, the aircraft surveillance and communication module 220 is referred to as the ASC module 220. The ASC module 220 may include a receiver 216 and a transmitter, both of which cooperate to facilitate communication and surveillance. This permits the ASC module 220 to send and receive data and pertinent information. However, the communication and surveillance function of ASC module 220 does not need to include both a transmitter and a receiver 216. For example, it is contemplated that the aircraft may incorporate an ASC module 220 that includes only a receiver 216 and not a transmitter. In this alternative configuration, the aircraft is contemplated to transmit data and information via an integral transmitter or via one or more devices that are available for communication on the aircraft. For example, the aircraft may receive and transmit information via a receiver/transmitter (i.e., a communications radio) that is not a component of the surveillance and communication function of ASC module 220.

The hardware and/or software module 218, that receives input and calculates trajectories for the aircraft, is referred to as the TAP module 218. Because the TAP module 218 is contemplated to be a combination of hardware and software that executes code (i.e., instructions and algorithms) on a suitable processor, the TAP module 218 combines both hardware and software so that it may perform the requisite calculations. In other words, the TAP module 218 may be coded into a semiconductor component (i.e., a PROM or EPROM (including one or both of volatile and/or non-volatile memory)) without departing from the scope of the present disclosure. It is noted that, because the TAP module 218 is considered to combine both hardware and software, the TAP module 218 may be a portable device that may be brought on board the aircraft by a member of the flight crew. Portability, however, is not required. Moreover, portability may not be possible due to constraints for aircraft certification that are imposed by the Federal Aviation Administration ("FAA") or equivalent regulatory agencies worldwide.

The TASAR module 212 may encompass components and/or software that facilitate the formation of optimal and conflict-free trajectory requests, the details of which are provided below. The ASC module 220 may also be considered to be a part of the TASAR module 212. Here, the ASC module 220 is connected to and communicates with the TAP module 218 via a communication channel 232. The TAP module 218 also may receive data and information from other, internal inputs 234 via a communication channel 236. The TAP module 218 may receive data and information from other, external inputs 238 via one or more communication channels 240, 241.

So that the pilot may have access to the information generated by the TAP module 218, a display 242 is incorporated into the TAP module 218 and communicates with the TAP application 230 via a communication channel 244. In another contemplated embodiment (not shown in FIG. 2), the display 242 may be connected to the TASAR module 212 (or, alternatively, directly to the TAP module 218) via communication channel 244. The display 242 may be a suitable optical display, such as a monitor. Alternatively, the display 242 may be auditory only, such as vocal information (i.e., provided by a speech synthesizer within the TASAR module 212) so that the information from the TASAR module 212 is conveyed to the flight crew via speakers, headsets, or the like. Display 242 may also be a two-way display 242, to provide visual information but also functions as an input device. Specifically, the display 242 may incorporate a touch-sensitive surface so that the pilot (or flight crew member) may input data via the display 242 in addition to receiving visual information via the display 242.

With further reference to the display 242, it is noted that the pilot may have access to a separate input device for providing flight information and flight parameters to an onboard computer, such as a Flight Management System. As should be apparent, therefore, the display 242 may be a convenient vehicle for consolidation of all pilot input. Alternatively, the display 242 may simply provide a separate and independent platform for the pilot input interface device.

With continued reference to FIG. 2, it is noted that each of the communication channels 232, 236, 244 are contemplated, but not required, to be two-way communication channels. As such, a one-way communication channel and/or multiple one-way communication channels may be employed without departing from the scope of the present disclosure. Still further, the individual devices may communicate with each other via a suitable data bus or a suitable alternative. In other words, the exact connections between the devices and the TAP module 218 are not critical to the operation of the present invention.

As also depicted in FIG. 2, the external inputs 238 may provide information via a wireless communication channel 241. The information from the external inputs 238, therefore, may travel via one or both of the communication channels 240, 241 for input to the TAP module 218. The external inputs 238 may include information from the ground tower and provide data from a TIS-B, among other data inputs, for example.

It is noted that the communication channels 232, 236, 244 are contemplated to be wired connections, since the ASC module 220, the internal inputs 234, and the display 242 are all internal to the aircraft. The communication channels 240, 241 are considered to be wireless communication channels, since the external inputs 238 are external to the aircraft. As should be apparent to those skilled in the art, any one of the communication channels 232, 236, 244 also may be wireless without departing from the scope of the present invention.

As noted above, it is contemplated for one embodiment that the information from the TAP module 218 will not require a display 242 to provide traffic information to the flight crew. Such a display 242 is referred to in the art as a cockpit display of traffic information or "CDTI." This embodiment is considered to be beneficial for at least one reason. Specifically, if a CDTI is omitted from the operation of the present disclosure, systems of the present disclosure may be provided on an aircraft without the need for certification and associated cost issues that are common with displaying traffic information in the cockpit. In this embodiment, rather than the pilot interpreting a traffic display, the surveillance data may be provided to other automation equipment available on the aircraft, which in turn supports the pilot in formulating conflict-free requests. Thus, at least with respect to this embodiment, aspects of the present disclosure support early and low-cost adoption on platforms not normally approved for traffic display, such as Class 2 Electronic Flight Bags ("EFBs").

In further contemplated embodiment, the configuration shown in FIG. 2 may be modified without departing from the scope of the present disclosure. For example, the ASC module 220 may be external to the aircraft, located at a ground-based station. The TAP module 218 may be located on the aircraft 214. Therefore, the TASAR module 212 may not be disposed, as a single unit, on board the aircraft 214. Instead, the TASAR module 212 may benefit from a distributed architecture, as described. In this embodiment, the communication channels 232, 240, 241 may be wireless, as should be apparent.

In a further contemplated embodiment, with the receiver 216 on the aircraft 214, the ASC module 220 may transmit information to the aircraft 214. Data is received by the receiver 216 and then provided to the TAP module 218 via the communication line 233. In this embodiment, the display 242 also is a part of the TAP module 218.

In yet another contemplated embodiment, the ASC module 220 may be divided into two components, the surveillance module and the communications module. The communications module may be onboard the aircraft 214 while the surveillance module may not be.

As should be apparent from the embodiments described herein, the present disclosure may be embodied in any of a number of different arrangements of components. The different variations, in addition to those that become apparent to those skilled in the art based on the specific embodiments illustrated and described, also as intended to be encompassed by the present disclosure. In other words, as noted above, the embodiments described herein are intended to be exemplary of the scope of the present invention and not limiting of the present disclosure.

It is noted that a basic arrangement of components for a TASAR installation may include the TAP module 218, the receiver 216, and the internal inputs 234. The TAP module 218 may house the TAP application 230. The receiver 216 may receive information surveillance relevant to a proximate aircraft and/or other hazard information (such as data from external inputs 238). The receiver 216 may then provide that information to the TAP module 218. Separately, the internal inputs 234 may provide information regarding the flight path of the aircraft 214. The TAP application 230 may then process the information about the proximate aircraft and the aircraft 214 to suggest a trajectory that may be acceptable to ATC.

Other arrangements of components are contemplated, as discussed in connection with FIG. 2. Moreover, any one component from FIG. 2 may be added to the basic construction, thereby defining further variations thereof.

As already discussed, one purpose of the present disclosure may be to advise the pilot of possible trajectory changes that might be beneficial to the flight and also that may be likely to increase the probability of ATC approval of pilot-initiated trajectory change requests, thereby increasing the portion of the flight flown on or near a desired trajectory (e.g., fuel efficiency, minimum flight time, low turbulence, etc.). For purposes of the discussion that follows, the aircraft 214 on which a particular pilot and/or flight crew is stationed is referred to as "the ownship" to distinguish that aircraft 214 from other aircraft (i.e., traffic aircraft 120 of FIG. 1) in the vicinity of the ownship 214.

As noted above, traffic surveillance information with respect to nearby aircraft may be received by the TAP module 218 on the ownship 214. The TAP module 218 may include an onboard software application (the "Traffic Aware Planner" or "TAP" application 230), which processes the surveillance information and performs conflict probing of possible changes to the trajectory for the ownship 214. In addition to surveillance information, the TAP application 230 also may process other data including hazard data.

The TAP Module 218 may be used by aircraft pilots to identify trajectory improvement opportunities that avoid nearby air traffic, as well as potentially avoiding weather, special-use airspace, and other hazards. For purposes of the discussion that follows, the display 242 is referred to as the TAP Human Machine Interface (HMI) display 242. The TAP HMI display 242 may provide a graphical user interface for the pilot to interact with the TAP module 218. As further described herein, the TAP HMI display 242 may display TAP-generated solutions for optimizing the aircraft's route and/or altitude in an automatic mode, as well as providing controls for the pilot adjust automatic mode settings. The TAP HMI display 242 may also enable the pilot to enter a desired route/altitude change for evaluation in a manual mode and may provide additional screens for pilot entry and/or confirmation of supplemental data required for the TAP module 218 to function properly or to improve its accuracy.

Further, the TAP HMI display 242 may incorporate human-factors principles for achieving high degrees of usability and acceptability by pilots. In particular, the TAP HMI display 242 may incorporate many design characteristics, features, and stylistic elements associated with touch-screen tablet computers, the choice EFB platform type for many aircraft operators.

When the TAP software application is launched, a startup checklist screen is displayed to allow the pilot to ensure the TAP application is properly configured and initialized with correct information it needs regarding the upcoming flight. This screen serves as a pilot's checklist to confirm the TAP application's status and settings and to enter, verify, or correct route information that TAP application will use while monitoring for route-optimization opportunities during the flight. Each checklist item is represented by a button. Inactive (gray) buttons may automatically become active (blue) buttons as the pilot progresses through the checklist.

As described herein, the TAP software application is contemplated as an advisory tool only, without serving a critical function on the flight deck or replacing any required capability on an aircraft's minimum equipment list. The flight crew's use of the TAP application may therefore be completely optional, and it can be ignored or disengaged at any time and for any reason. In certain embodiments, the availability of the TAP application on the flight deck does not alter roles and responsibilities of the flight crew, nor does it alter the procedures or phraseology for requesting route changes from ATC. In particular, the provision of route change solutions by the TAP application is not contemplated to constitute flight-crew authority to execute the route change, as all route changes when operating under Instrument Flight Rules must be approved by ATC. Further, the TAP system is not contemplated to remove the need to coordinate with Dispatch if the change is outside of the operational control limits imposed by the airline. Whereas the objective of the TAP application is to provide beneficial route-optimization solutions that have an increased likelihood of ATC approval, there is no guarantee that ATC will approve TAP-generated route changes, as ATC may have additional information not currently available to the TAP application that could make the route-change request not approvable at the time.

The TAP application may provide route optimization during an in-route phase of flight. In some embodiments, the TAP application may be initialized on the ground prior to departure, however it will remain in a standby condition until the aircraft reaches 10,000 feet. Once the TAP application has entered operational mode, it may be used at any point during the flight up to and until descending through 10,000 feet. Generally, route optimization opportunities will diminish late in the flight as the aircraft approaches its destination.

Figure 3:
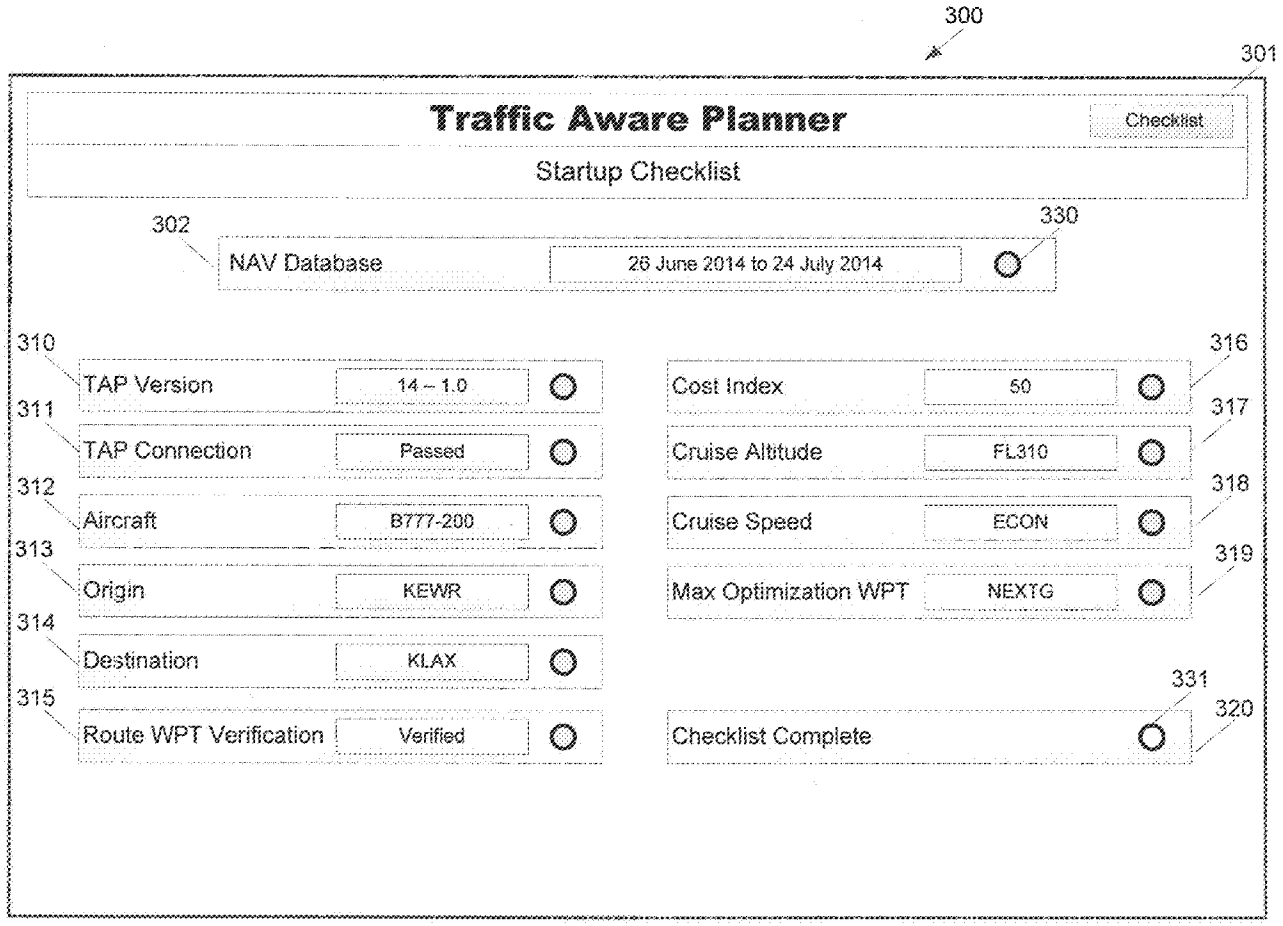
FIG. 3 is a schematic view of a first user interface device in accordance with an embodiment.

As shown in FIG. 3, an example startup checklist screen 300 is shown, including buttons for verification of: the navigation database 302, TAP software version 310, TAP connection tests 311, aircraft 312, route origin 313, route destination 314, route waypoints 315; cost index 316, cruise altitude 317, cruise speed 318, and a maximum optimization waypoint 319. The startup checklist screen 300 may include less buttons than shown in FIG. 3, or may contain additional buttons, without departing from the scope of the present disclosure. When progressing through the checklist, information to be verified or acknowledged by the pilot may be displayed in an entry window embedded in the button. In some examples, the pilot may touch the button's entry window to edit information using a popup keyboard. The keyboard may appear when the pilot touches the button's entry window. Otherwise, the pilot may touch the button outside the entry window to confirm the information and to indicate the task is complete. Each button may include a light icon which lights up and/or changes color to indicate the checklist item corresponding to the button has been completed. In certain examples, the pilot may only need to confirm and/or verify information already there. In some examples, the pilot may need to input information.

During completion of the checklist while the pilot is in the startup checklist screen 300, the TAP application automatically undergoes a series of connectivity tests to ensure all avionics connections and data subscriptions have successfully completed. Any failed tests of required connections or data will be indicated in the window, and the pilot will be required to exit the software. Otherwise, the window will indicate TAP connection has "passed" and the pilot acknowledges by touching the tap connection verification button 311. As shown in FIG. 3, light icon 330 corresponding to the navigation database verification button 302 is lit, indicating this checklist item has been completed. However, light icon 331 corresponding to the checklist complete button 320 is not lit up, indicating the startup checklist has not yet been completed by the pilot.

For the route waypoint verification button 315, the TAP application may use a navigation database to infer waypoint names from latitude and longitude data provided by the FMS to external systems. Inferred waypoint names may need to be verified or corrected by the pilot. In some examples, a drop down list of inferred waypoints may be displayed and the pilot may touch a waypoint name to verify the waypoint or touch a "Verify All" to verify all waypoint names in the list. The pilot may also be able to select a "Replace Waypoint" icon if a waypoint name has not yet been verified. Further, waypoint constraints for waypoints on the active route may optionally be entered by the pilot to improve the accuracy of TAP's fuel and flight-time computations. The TAP application initializes with no active-route waypoint constraints prior to the destination. If the pilot desires to enter waypoint constraints, he may touch the button's entry window to navigate directly to the route constraints screen or touch the button outside the button's entry window to continue without entering waypoint constraints.

Upon successful completion of the various checklist buttons of the startup check list screen 300, the TAP application may automatically transition to an automatic mode with the interface displaying an auto mode screen, and remain in a standby condition until the aircraft reaches 10,000 feet. If the checklist buttons of the startup check list screen 300 cannot be successfully completed, the pilot may need to exit the TAP application using the navigation menu 301 in the top bar.

The route constraints screen 400 may enable the pilot to update route information entered in the startup checklist screen 300 and to optionally specify waypoint constraints for the active route to increase the accuracy of TAP application computations. The route constraints screen 400 may allow the pilot to enter additional route information to improve TAP's trajectory predictions. Information already entered on the startup checklist screen may be populated in the button windows and need not be verified or entered again, unless the pilot wishes to update a setting.

Figure 4:
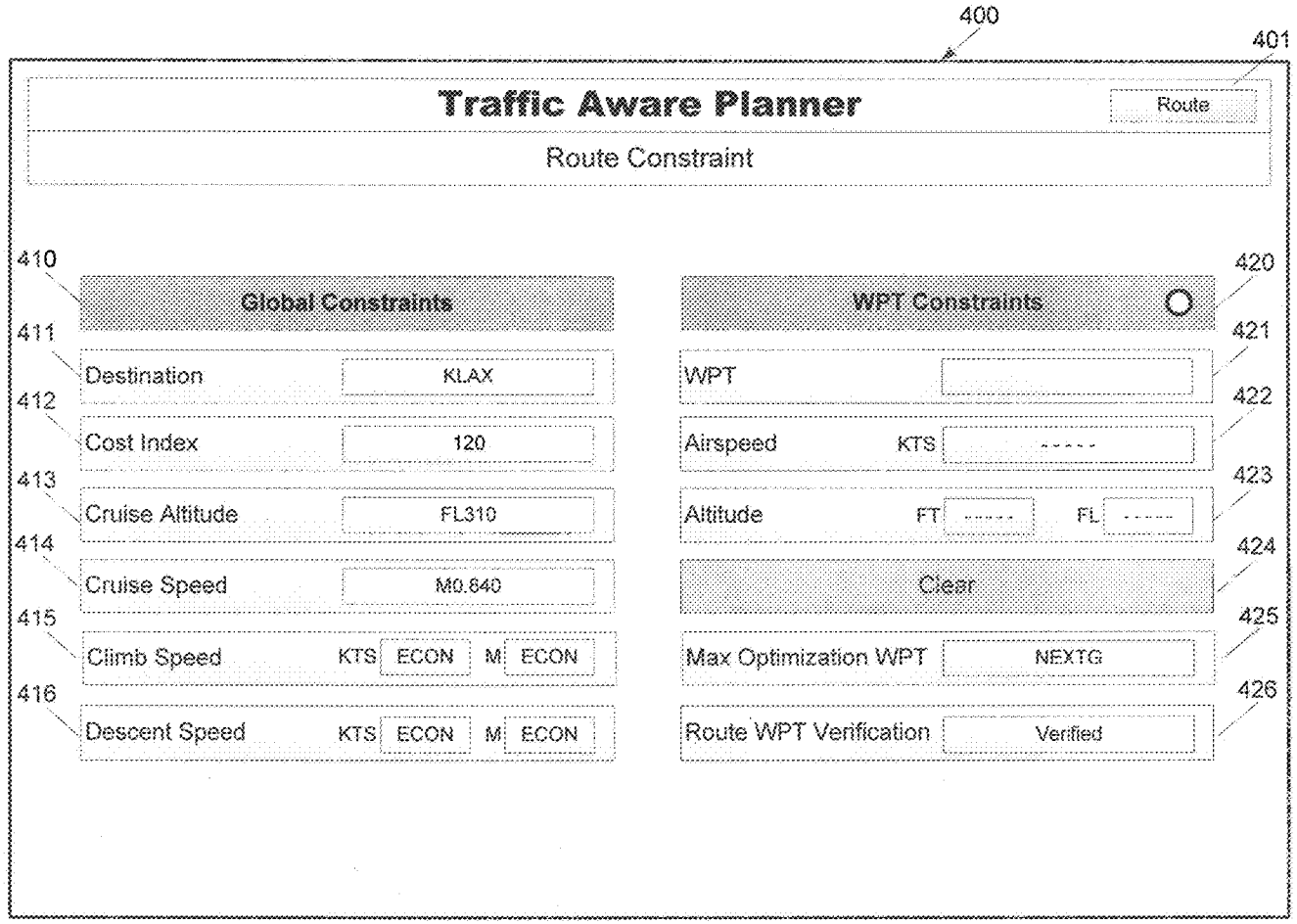
FIG. 4 is a schematic view of a second user interface device in accordance with an embodiment.

As shown in FIG. 4, the route constraints screen 400 may include a series of global constraints options 410 and a series of waypoint constraints options 420. The global constraints options 410 may include parameters which were previously verified in the startup checklist screen 300 and/or new parameters for the pilot to verify/input. As shown in FIG. 4, the global constraint list includes destination 411, cost index 412, intended cruise altitude 413, intended cruise speed 414, planned calibrated climb speed 415 and planned calibrated descent speed 416. The speed windows may default to the Economy (ECON) setting, but the pilot may enter specific values if known.

The waypoint constraints list in FIG. 4 includes, waypoints 421, airspeed 422, altitude 423, a maximum optimization waypoint 425, and route waypoint verification (to verify or correct TAP-inferred waypoints) 426. These waypoint constraints may not be provided automatically by the avionics systems of many aircraft and therefore may need to be entered and maintained manually by the pilot. Waypoint constraints may consist of crossing restrictions in altitude and/or calibrated airspeed, which the pilot may enter for one or more waypoints on the active route. The pilot may also verify active route waypoint names 426, should the waypoint list have changed. The TAP application may receive a list of waypoints from the FMS specified as unnamed latitude and longitude coordinates. To assign waypoint names, the TAP application may use the navigation database to locate the closest named waypoint to the specified coordinates. In some examples, the pilot may have already reviewed and verified the name assignments and has made corrections as needed in the startup checklist screen 300. During the flight, if the FMS active route is updated with new waypoints that require name verification, the window of the route waypoint verification button 426 may be indicated "Unverified." The pilot may again verify the TAP-inferred waypoint names using the same method as before. The list of TAP-inferred waypoint names is displayed in the popup menu when the pilot touches the button's window.

The pilot may also update the selection of the maximum optimization waypoint button 425. This selection may be used as a default optimization limit, meaning that any lateral path changes will rejoin the FMS active route at or before this waypoint. This setting will also limit the selection list under the "Optimize to WPT" button 522 on the auto mode screen 500. To update the maximum optimization waypoint button 425, the pilot may selects a desired waypoint from the list of active route waypoints.

Standard Terminal Arrival Route (STAR) will often include crossing restrictions at specific waypoints, and these restrictions are typically entered into the FMS. Entering these restrictions into the TAP application may also improve trajectory predictions and the accuracy of computed time and fuel outcomes. In particular, to enter a waypoint constraint, the pilot may touch the waypoint constraints button 420 to display a menu of the active route waypoints. The pilot may then select a waypoint from the menu, and the waypoint name is displayed in the button window. The pilot may then enter altitude and/or speed constraints by touching the appropriate buttons 422, 423.

The auto mode screen may represent a primary operational mode of the TAP application. In some examples, a pilot may operate the TAP application in this mode for the majority of the flight, allowing the TAP application to automatically monitor for route-optimization opportunities. As shown in FIG. 5A, the layout of auto mode screen 500 includes a solutions panel 510, an optimization controls panel 520 and a visualization panel 530. Additional control settings are located along the top bar 540 and bottom bar 550.

The solutions panel 510 may display route changes computed by the TAP application that may optimize the flight. Up to three route-change solutions may be displayed: an optimal lateral solution 511, an optimal vertical solution 512, and an optimal combination lateral/vertical solution 513. These solutions 511, 512, 513 may be updated at least once a minute based on the latest information available. The lateral solution 511 may include a rejoin waypoint from the FMS active route plus up to two optional off-route waypoints preceding the rejoin waypoint. The vertical solution 512 may be a flight level change only. The combination solution 513 may combine a flight level change with a lateral route change and is computed independently from the other two solutions 511, 512. As shown in the embodiment of FIG. 5A, displayed with each solution are the outcomes in estimated fuel and time savings or costs associated with the solution. By selecting one of the provided solution buttons 511, 512, 513, a solution may be previewed and/or selected in the visualization panel 530. A message window 514 may provide status information to the pilot, including potential hazards to one or more solutions.

In some embodiments, the Auto Mode may be considered to be the primary operational mode of the TAP application. When in use, i.e., when auto mode screen 500 is displayed, the TAP application may indicate that new solutions are being computed by displaying a message such a "Processing" in the message window 514. During this time, hundreds of candidate route changes may be scanned. When one or more beneficial solutions are found, they are displayed in the solutions panel 510 as "active" buttons by displaying them with a particular color, e.g., blue. The TAP application may only display solutions that improve the flight based on the pilot-specified optimization objective (fuel or time savings). The lateral, vertical, and combination buttons 511, 512, 513 may each display only the best solution of that type. If no beneficial solution of a particular type is found, the button may be displayed as "inactive" by displaying it with a particular color e.g., gray. For example, if the aircraft is currently on a best available route, all three solution buttons 511, 512, 513 may be inactive. Meanwhile as the flight progresses, the TAP application may continue to monitor for emerging opportunities to improve the aircraft's route, e.g., in terms of fuel and time savings. The information displayed on each button 511, 512, 513 may include the solution type (e.g., lateral), the outcome in fuel/time saved or lost as a result of the route change, and the route change itself, each which may be displayed in a different color. New off-route waypoints added by the TAP application may be displayed in another color, and the rejoin waypoint where the solution merges with the active route may be displayed in yet a different color. All lateral and combination solutions may include a rejoin waypoint, as the TAP application is designed to probe complete trajectories while the aircraft is operating in LNAV and VNAV autoflight modes.

In some embodiments, the solutions displayed on the solution buttons 511, 512, 513 will be clear of known hazards. These hazards are dependent on the data feeds and may include, for example, predicted intersections with active Special Use Airspace (SUA), convective weather, and close proximity to ADS-B traffic. Confirmation that a solution is clear of hazards is indicated by a light on the solution buttons. If the aircraft's current position is inside the boundaries of an SUA or weather hazard, solution generation will be suspended until the aircraft emerges from the hazard. For the convenience of the pilot, a border, e.g., a colored border, around a solution button 511 provides at-a-glance identification of the best solution based on the optimization objective (fuel or time savings) compared with other solution buttons 512, 513.

Indicators 516, 517, 518 that join to the solution buttons 511, 512, 513 may indicate which of the solution buttons 511, 512, 513 is currently displayed on the visualization panel 530 for the pilot to preview by displaying a light along the selected indicator 516. The best solution may automatically be displayed in the visualization panel 530; however, the pilot may preview any solution by touching the solution button once.

The optimization controls panel 520 may enable the pilot to set the parameters of the TAP application's route-optimization engine. As shown in the embodiment of FIG. 5A, an "Optimize For" control button 521 may specify an optimization goal, e.g., either to save fuel or time. The "Optimize to WPT" control button 522 may specify a limiting waypoint on the FMS active route of the optimization search. In other words, a waypoint specific in the "Optimize to WPT" control button 522 may be used as a limit beyond which the TAP application will not alter the active route and may be referred to as the rejoin waypoint. By default, the rejoin waypoint may be the maximum optimization waypoint 319 specified in the startup checklist screen 300. The pilot may select a closer waypoint to be used as a temporary rejoin waypoint by touching the "Optimize to WPT" button 522 and selecting an active route waypoint on the visualization panel 530 or from a popup menu. The "Max Off-Route WPTs" control button 523 may specify a maximum complexity of the optimization search in terms of how many additional waypoints may be considered before rejoining the FMS active route. In computing lateral and combination solutions, the TAP application may be able to insert up to two off-route waypoints prior to the rejoin waypoint. The pilot may touch the "Max Off-Route WPTs" button 523 and select a desired value from the menu. For example, the pilot may restrict the computations to one or zero off-route waypoints in order to reduce the complexity of the request to ATC. Changing any of these three control buttons 521, 522, 523 may cause the TAP application to clear the existing solutions and restart an optimization search.

The visualization panel 530 may display an FMS active route 532 normally in track-up orientation and may also be used to preview any TAP-generated route change from the solutions panel as well as various information display layers. For example and as shown in FIG. 5A, the optimal lateral solution 511 is selected (as indicated by the lit up indicator 516 corresponding to the optimal lateral solution 511) and the route 534 associated with the optimal lateral solution 511 is displayed in the visualization panel 530. Active route information 532 may be displayed in the visualization panel 530 in one color, e.g., magenta, and a selected TAP-generated route information 534 may be displayed in a different color, e.g., cyan. The aircraft's present position may be located near the bottom center of the visualization panel 530. Current range settings 531 may be shown along a top portion of the visualization panel 530 such as display orientation and the map display mode.

The visualization panel 530 typically displays the FMS active route 532 in a track-up orientation and can be used to preview any TAP-generated route change 534 from the solutions panel 510. Along the top of the visualization panel 530 are the current range setting and the panel's track-up orientation. In the normal orientation, the aircraft's present position is located near the bottom center of the visualization panel 530. The range setting may be controlled using the zoom in and zoom out buttons 554, 555 on the bottom bar 550.

The active route 532 may be displayed in a first color and a first line type and the TAP-generated route 534 may be displayed in a second color and a second line type. To prevent display clutter, only a select few active-route waypoints 533*a-g* are labeled, such as the next waypoint 533*a*, the TAP-solution rejoin waypoint 533*e*, and the TAP Optimization Limit waypoint (enclosed in a box) 533*e*. However, in some embodiments all off-route waypoints may be labeled, and where there is sufficient room, the route's initial leg may be labeled with magnetic bearing and distance to next waypoint.

As shown in FIG. 5A, the top bar 540 may include cruise settings 541 (with verification button 542, cruise altitude 543 and cruise speed 544), e.g., entered by the pilot in the startup checklist screen 300 and then displayed on the top bar 540 for easy reference and editing. The top bar 540 may also include a data feeds drop-down list 545 for indicating a status of external data used by the TAP application and a navigation menu 546 to switch between automatic and manual modes or to shut down the TAP application. The data feeds status 545 may indicate a number of feeds including ownship and traffic data feeds, as well as those listed in the layers menu button 557. A green LED light on the data feeds button 545 may indicate that all data feeds have received recent updates within the expected window for each data source. A yellow LED light may indicate that one or more data updates were not received at the expected interval. Within the data feeds status menu 545, items with potentially expired data may be indicated with a yellow LED light and the time at which the last data was received. Future data feeds not currently available may be shown in gray.

The bottom bar 550 may include an ATC approved indicator 551, an ATC denied indicator 552 and other controls for controlling options on the visualization panel 520, such as zoom out 554, zoom in 555 and a winds flight level control button 556 and layer button 557, each described in more detail below.

To turn the layers on in the visualization panel 530, the pilot may select the desired layers in the layers menu 557. Examples of layers that can be displayed may include convection polygons, SUA polygons, and winds. Convection polygons indicate regions potentially impacted by convective weather and are labeled with "WX" and the convection ceiling altitude, if available, such as convection polygon 536 in FIGS. 5A-B. SUA polygons indicate active airspace restrictions and are labeled with the SUA designated number or name and the ceiling and floor of the airspace. TAP solutions may be designed to remain outside of WX and SUA polygons. Wind data are shown as standard wind barbs 538 on a rectangular grid for a single flight level. The flight level of the displayed winds may be indicated on the winds flight level control button 556 next to the layers button 557. The pilot may use this button to change the flight level of the displayed wind data.

Known hazards 536, 537 associated with the route change may be displayed on the visualization panel 530. Such hazards may include predicted intersections with an active SUA, convective weather, and close proximity to ADS-B traffic. Since Auto Mode solutions are designed to avoid these hazards, they would be rarely displayed in Auto Mode, and only for selected solutions for which new hazards are detected sometime after the original solution was computed.

While a solution is being previewed, new solutions of the same type may periodically be provided, as the TAP application continues to monitor for the best available route-optimization opportunities. However, as shown in FIG. 5B, when the pilot identifies a solution of interest 511 and selects the solution button 511 by touching it a second time, the other two solution buttons 512, 513 become inactive and the route change of the selected solution will be frozen on the visualization panel 530 and the solution button 511 will not be updated again unless the pilot releases it. Further, the non-selected solution buttons 512, 513 may be displayed as grayed out and the corresponding indicator lights in the solution buttons may be turned off. However, the outcomes may continue to be updated and potential hazards will continue to be assessed. With the selected solution frozen, the pilot may review the proposed route change for operational acceptability using standard company procedures. Typically, these may include entering the route change into the FMS, consulting FMS-computed fuel and flight time estimates, consulting other onboard systems such as weather radar, and where applicable, consulting with company flight operations. The pilot may then release the selected solution by touching the release button 516 or proceed with making an ATC request.

ATC requests may be made using normal request procedures and phraseology. The ATC response buttons 551, 552 on the bottom bar may become active when a solution is selected. Having selected a solution and reviewed it for acceptability, the pilot then make the request of ATC. The pilot may record the ATC response as either ATC Approved or ATC Denied by respectively selecting buttons 551, 552. Each button 551, 552 may contain a short menu of options to record additional information. For approved requests, the pilot may indicate whether the request was approved "As Requested" or "Amended." For denied requests, the pilot may indicates a reason, if any was provided by ATC. It is not necessary, however, to query ATC for the reason. These records may aid the analysis of TAP performance and support future improvements to the software. The ATC response selection may be updated by the pilot until the solution is released.

The manual mode screen 600 may allow a pilot to enter a route change directly into the TAP application and have it evaluate the outcomes and hazards associated with that change. The layout of the manual mode screen 600 includes a visualization panel 630, top bar 640, and bottom bar 650 similar to the auto mode screen 500, as well as an entry tools panel 610 and a route tray panel 620. Further the top bar 640 and bottom bar 650 of the manual mode screen 600 may include the same buttons or similar buttons as the top bar 540 and bottom bar 550 of the auto mode screen 500. For example, a pilot may enter a route change in the manual mode screen 600 using tools in the entry tools panel 610, and the entered route may be displayed in the route tray panel 620.

The entry tools panel 610 may provide the tools for the pilot to enter a desired route change into TAP application for evaluation. Similar to the route-change solutions 510 provided in auto mode screen, the pilot may specify a lateral route entry, a vertical route entry (flight level), or a combination route entry. A change in flight level may be accomplished using the flight level change button 611, e.g., from a scrollable menu. Changes to the lateral path may be accomplished using the add waypoint button 612 and rejoin waypoint button 613, e.g., from a scrollable menu of various waypoints or by tapping the desired map location in the visualization panel 630. In other words, the visualization panel 630 may include a route map with touchscreen capabilities, so that a user may touch on the map to locate and/or select waypoints. The add waypoint button 612 may allow the pilot to optionally specify up to two new waypoints that are currently not on the FMS active route. The rejoin waypoint button 613 may be used to identify which active-route waypoint will complete the desired route change. Both tools can be used in conjunction with touching directly on the visualization panel 630 to select waypoints or with a keyboard tool. Because the route changes are entered by the pilot and not generated by TAP in manual mode, the resulting new route may not necessarily be a route optimization and may not include time or fuel savings.

The route tray panel 620 may include a tray 622, a message window 621, and an outcome window 623. The tray 622 may display each element of the pilot-entered route change and may permit editing of each element by the pilot. In other words, each elements of an entered route may be displayed as route components 622*a-d* and may appear in the route tray 622 as separate buttons. In some example, a complete route entry may have between one and four route component buttons, such as a flight level 622*a* (specified in the flight level change button 611), up to two off-route waypoints 622*b*, 622*c* (specified in the add waypoint button 612), and a rejoin waypoint 622*d* (specified in the rejoin waypoint button 613). The separate buttons displayed for each element in the route tray 622 may enable each route component to be individually modified or deleted by the pilot.

A selected flight level may be displayed on a button in the route tray 622. If no changes to the lateral path are specified, the TAP application may assume the lateral path will remain unchanged and proceed to compute outcomes of the route change in terms of fuel and time and to determine presence of any known hazards associated with the route change. An LED light may be provided with each route component 622*a-d* in the route tray 622 to indicate whether there are any detected hazards associated with the inputted route change. All indicator lights are on for route components 622*a-d* in FIG. 6, indicating that the inputted route change is free of any detected hazards.

The message window 621 may provide status and hazard notifications associated with the entered route, similar to the auto mode. The outcome window 623 may display an estimated effect on fuel and flight time associated with the route change.

The visualization panel 630 may depict an inputted route by displaying the selected flight level 639 at the bottom of the panel. If the ATC response buttons 651, 652 shown as active may further indicate that the entry represents a complete route change that could be requested from ATC. Touching the highlighted flight level button 622*a* in the route tray 622 may bring up a menu of other available flight levels to modify the flight level settings.

The selected rejoin waypoint 622*d*, if specified, may be displayed in the route tray 622 and the TAP application may evaluate the route change immediately and may indicate whether it is clear of hazard (e.g., green LED light on) or is impacted by a hazard (e.g., yellow LED light on). When a desired rejoin waypoint is selected directly from the visualization panel 630, the corresponding button in the route tray 622 may be highlighted, e.g. in a blue color, indicating that the pilot may continue to select different waypoints on the visualization panel 630. The save button 614 may be pressed when the pilot would like to save the desired rejoin waypoint for TAP application to evaluate.

One or more route component buttons may be highlighted, e.g., in a blue color, indicating they are currently in Edit Mode. For example, if selected rejoin waypoint button 622*d* is displayed highlighted, it can be pressed for a waypoint list to reappear. Selecting a different active-route waypoint either from the list or from the visualization panel 630 may replace a previously selected waypoint with a newly selected waypoint. In such a case, new outcomes may be displayed in outcome window 623 and a determination for the presence of new hazards may be made.

Since flight level changes are associated with the entire route, an LED light corresponding to a flight level change button may be yellow if any portion of the route has a detected hazard. If a lateral route waypoint has a yellow LED light, then a hazard was detected on the leg either preceding or following the waypoint. Inspection of the visualization panel 630 may clarify a leg on which the hazard was detected. The message window 621 may indicate the nature of the hazard in yellow text, for example by displaying "Traffic" upon determining presence of a traffic hazard or "Weather in ~20 min." upon determining presence of convective weather and the approximate time until reaching the hazard. An indication may also be displayed that an ATC request to proceed is likely to be denied due to the detected hazard in the new route. Further, the path may also be displayed in yellow in the visualization panel 630 is a hazard is detected.

To resolve a hazard, the pilot may need to change one or more route components depending on the specific situation, and not necessarily the ones with a yellow LED light displayed. For example, the pilot may replace one selected off-route waypoint with a different off-route waypoint. The manual mode screen 500 may then subsequently update the display to indicate if the new route is affected by the same hazard, another hazard, or no hazards. The previous hazard, if no longer a predicted hazard, may be removed from the display. However, if another hazard it determined, it may automatically be displayed.

The Manual Mode may provide capabilities to the TAP application to easily add off-route waypoints to an entered route. For example, by the pilot may select a desired waypoint or waypoints from a popup menu or by the pilot directly touching a desired waypoint in a visualization panel showing a route map as described herein. Additionally, the pilot may change the selection of the maximum optimization waypoint entered in the route constraint screen 400.

After pilot makes a route change request to ATC for either the auto mode or the manual mode, tools are provided to record the ATC response for later analysis. The ATC approved buttons 551, 651 may indicate the whether the ATC approved the route changes as requested or amended. The ATC denied buttons 552, 652 may indicate a reason for denial, such as to maintain a preferred route, to avoid a certain hazard, or for an unspecified reason.

Aspects of the present disclosure provide pilots with optimized route changes that reduce fuel burn or flight time, avoids interactions with known traffic, weather and restricted airspace, and may be used by the pilots to request a trajectory change from air traffic control. TAP applications according to certain embodiments may be designed specifically to be a support tool, and not change any of the current procedures for requesting route changes from ATC or implementing them within the cockpit. The HMI design accounts for limitations of size, touch-screen only (no keyboard or mouse), and expected visibility issues of a Class 2 EFB mounted in a cockpit environment. TAP should minimize user inputs to perform core functionality.

Aspects of the present disclosure are oriented toward use on touchscreen tablet computers, while still supporting traditional EFB platforms. The map visualization features discussed herein provide significantly more information of the current route and proposed route change, as well as predicted hazards to the route, to increase pilot understanding of the TAP application's solutions and behavior. Certain colors and symbols discussed herein were designed to enable intuitive grasp of key information to minimize pilot workload. The startup checklist screen may facilitate pilot entry of key information required in the new operating environment of airline aircraft, and in a manner consistent with standard flight-deck procedures.

The TAP application is intended to provide a flight-efficiency benefit to aircraft operators and therefore incentivize these operators to equip their aircraft with the latest airborne surveillance technology. Accordingly, a key principle to the TAP application as described herein is that it does not induce more than minor pilot workload and not interfere with primary flight duties. The degree to which TAP application is considered easy to use may determine its acceptability by pilots and adoption by airlines and other users. Accordingly, the TAP HMI display may be a key element of this operator acceptability.

Various exemplary systems of the TAP application as discussed herein combine the functional user interface of the TAP software application with human centered design principles that achieve consistency with the style and interactivity of modem tablet application interfaces. The design is a balanced approach between providing sufficient information on the display for pilot decision making versus not requiring extensive FAA certification of the display. The TAP HMI display as described herein provides at-a-glance viewing of the most optimal trajectory-change solutions in both graphical and textual displays, while providing textual display of two alternative solutions which are also both easy to preview.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein. The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." As used herein, the term "and/or" includes any and all combinations of one or more of the associated listed items. As also used herein, the term "combinations thereof" includes combinations having at least one of the associated listed items, wherein the combination can further include additional, like non listed items. Further, the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other. Each range disclosed herein constitutes a disclosure of any point or sub-range lying within the disclosed range.

Reference throughout the specification to "another embodiment", "an embodiment", "exemplary embodiments", and so forth, means that a particular element (e.g., feature, structure, and/or characteristic) described in connection with the embodiment is included in at least one embodiment described herein, and can or cannot be present in other embodiments. In addition, it is to be understood that the described elements can be combined in any suitable manner in the various embodiments and are not limited to the specific combination in which they are discussed.

What is claimed is:

1. An in-cockpit flight trajectory modification system for an aircraft, comprising:

a receiver in communication with at least one of another aircraft and a ground-based system for receiving flight-related hazard information via wireless communication;

a traffic aware planner (TAP) module comprising a device configured to be on board the aircraft and having hardware and software for executing code, the TAP module operably connected to the receiver to receive the flight-related hazard information;

a user interface device operably connected to the TAP module and configured to be on board the aircraft to provide trajectory information associated with the aircraft and to receive user input corresponding to a request for a revised trajectory; and a TAP application housed in the TAP module and configured for calculating revised trajectories for the aircraft based at least on an active trajectory of the aircraft and the flight-related hazard information, wherein the user interface device is configured to display a graphical user interface comprising:

a solution panel dynamically displaying a first revised trajectory on a first solution button selectable by the user, a second revised trajectory on a second solution button selectable by the user, and a third revised trajectory on a third solution button selectable by the user, each of the first solution button, the second solution button, and the third solution button displaying information related to one of different revised trajectories calculated by the TAP module the information including outcome information indicating an estimated effect on a fuel usage and a flight time for that respective one of the revised trajectories compared to the active trajectory;

a visualization panel displaying at least a portion of one of the first revised trajectory, the second revised trajectory, and the third revised trajectory in response to the user's selection of a respective one of the first solution button, the second solution button, or the third solution button; and a manual mode selection button, wherein the graphical user interface is configured to display a manual mode entry panel in place of the solution panel in response to the user's selection of the manual mode selection button, the manual mode entry panel displaying one or more buttons configured to enable the user to enter a desired route change independent of the first revised trajectory, the second revised trajectory, and the third revised trajectory.

2. The system of claim 1, wherein the graphical user interface further comprises a waypoint selection panel and, responsive to receiving one or more waypoint selections in the waypoint selection panel, the user interface device is configured to cause the TAP application to calculate new revised trajectories based at least on the one or more waypoint selections.

3. The system of claim 2, wherein the waypoint selection panel is configured to receive a waypoint selection of at least one of an active-trajectory rejoin waypoint and a revised trajectory waypoint, wherein responsive to receiving the waypoint selection of the active-trajectory rejoin waypoint in the waypoint selection panel, the user interface device is configured to cause the TAP application to calculate the new revised trajectories to rejoin the active trajectory at the active-trajectory rejoin waypoint, and wherein responsive to receiving the waypoint selection of the revised trajectory waypoint in the waypoint selection panel, the user interface device is configured to cause the TAP application to calculate the new revised trajectories to pass through the revised trajectory waypoint.

4. The system of claim 1, wherein the graphical user interface is further configured to receive a user request input to submit a selected one of the first revised trajectory, the second revised trajectory, and the third revised trajectory to an air traffic control system for approval.

5. The system of claim 1, wherein the graphical user interface includes a route constraint selection portion for receiving one or more constraints to be used by the TAP application in calculating the revised trajectories.

6. The system of claim 1, wherein the graphical user interface includes a graphical display layers selection menu for receiving user requests to display one or more hazard layers on the visualization panel.

7. The system of claim 1, wherein the graphical user interface includes an optimization objective display for receiving one or more user selection parameters for determining an optimal revised trajectory.

8. The system of claim 1, wherein the graphical user interface includes a data feed status display.

9. The system of claim 1, wherein:

the graphical user interface is further configured such that the solution panel displays a most optimal revised trajectory of the first revised trajectory, the second revised trajectory, and the third revised trajectory in a color different than others of the first revised trajectory, the second revised trajectory, and the third revised trajectory; and the graphical user interface is further configured to display the manual mode selection button in a top bar above the solution panel and the visualization panel.

10. The system of claim 1, wherein the first revised trajectory is an optimal lateral solution, the second revised trajectory is an optimal vertical solution, and the third revised trajectory is an optimal combination lateral/vertical solution.

11. A method for generating/displaying an in-flight optimizing trajectory for an aircraft in a graphical user interface of a user interface device configured to be on board the aircraft to provide trajectory information associated with the aircraft and to receive user input corresponding to a request for a revised trajectory, comprising:

receiving input of an optimization criteria for the aircraft into a traffic aware planner (TAP) application housed in a TAP module that comprises a device configured to be on board the aircraft and having hardware and software for executing code;

receiving flight data for the aircraft on an active trajectory with at least one internal input device operably connected to the TAP module;

receiving hazard information into the TAP application from a receiver, wherein the TAP application is configured to determine a presence of one or more hazards based on the hazard information and wherein the receiver is in wireless communication with at least one of another aircraft and a ground-based system to receive the hazard information via wireless communication;

calculating and generating revised trajectories for the aircraft with the TAP application based on the flight data and the presence of one or more hazards;

dynamically displaying in a solution panel of the graphical user interface a first revised trajectory on a first solution button selectable by the user, a second revised trajectory on a second solution button selectable by the user, and a third revised trajectory on a third solution button selectable by the user, each of the first solution button, the second solution button, and the third solution button displaying information related to one of different revised trajectories calculated by the TAP module, the information including outcome information indicating an estimated effect on a fuel usage and a flight time for that respective one of the revised trajectories compared to the active trajectory;

displaying in a visualization panel of the graphical user interface at least a portion one of the first revised trajectory, the second revised trajectory, and the third revised trajectory in response to the user's selection of a respective one of the first solution button, the second solution button, or the third solution button;

displaying a manual mode selection button; and displaying in a manual mode entry panel one or more buttons configured to enable the user to enter a desired route change independent of the first revised trajectory, the second revised trajectory, and the third revised trajectory, the manual mode entry panel displayed in place of the solution panel in response to the user's selection of the manual mode selection button.

12. The method of claim 11, further comprising receiving a selection of one or more waypoints in the graphical user interface for use in determining new revised flight trajectories.

13. The method of claim 11, further comprising sending a request to change to air traffic control to change to a selected one of the first revised trajectory, the second revised trajectory, and the third revised trajectory.

14. The method of claim 11, further comprising receiving one or more route constraints for determining new revised flight trajectories.

15. The method of claim 11, further comprising displaying at least a portion of the received hazard information in a hazard layer in the visualization panel of the graphical user interface.

16. The method of claim 11, further comprising displaying a data feed status in the graphical user interface.

17. The method of claim 11, further comprising:

displaying a most optimal route of the first revised trajectory, the second revised trajectory, and the third revised trajectory in a different color in the visualization panel of the graphical user interface from the others of the first revised trajectory, the second revised trajectory, and the third revised trajectory, wherein the manual mode selection button is displayed in a top bar above the solution panel and the visualization panel.

18. The method of claim 11, wherein calculating and generating the revised trajectories for the aircraft with the TAP application based on the flight data and the presence of one or more hazards includes determining an optimal flight trajectory for a lateral modification, a vertical modification, and for a combination modification.

19. The method of claim 11, wherein the first revised trajectory is an optimal lateral solution, the second revised trajectory is an optimal vertical solution, and the third revised trajectory is an optimal combination lateral/vertical solution.

20. An in-cockpit flight trajectory modification graphical user interface for display on a user device in an aircraft, comprising:

a solution panel dynamically displaying a first revised trajectory on a first solution button selectable by a user, a second revised trajectory on a second solution button selectable by the user, and a third revised trajectory on a third solution button selectable by the user, each of the first solution button, the second solution button, and the third solution button displaying information related to one of different revised trajectories including outcome information indicating an estimated effect on a fuel usage and a flight time for that respective one of the revised trajectories compared to an active trajectory of the aircraft;

a visualization panel displaying at least a portion of flight related hazard information and at least a portion of one of the first revised trajectory, the second revised trajectory, and the third revised trajectory in response to the user's selection of a respective one of the first solution button, the second solution button, or the third solution button, wherein the flight hazard information is provided from a receiver in communication with at least one of another aircraft and a ground-based system for receiving the flight hazard information via wireless communication;

a manual mode selection button; and a manual mode entry panel displayed in place of the solution panel in response to the user's selection of the manual mode selection button, the manual mode entry panel displaying one or more buttons configured to enable the user to enter a desired route change independent of the first revised trajectory, the second revised trajectory, and the third revised trajectory.

* * * * *